US007900786B2

(12) United States Patent
Hepburn

(10) Patent No.: US 7,900,786 B2
(45) Date of Patent: Mar. 8, 2011

(54) TELESCOPING, UNCOUPLING LEVER AND GLIDE HOUSINGS FOR A RAILROAD CAR

(75) Inventor: Christopher D. Hepburn, Highland, IN (US)

(73) Assignee: Stanrail Corporation, Gary, IN (US)

( * ) Notice: Subject to any disclaimer, the term of this patent is extended or adjusted under 35 U.S.C. 154(b) by 246 days.

(21) Appl. No.: 12/042,874

(22) Filed: Mar. 5, 2008

(65) Prior Publication Data

US 2009/0223919 A1 Sep. 10, 2009

(51) Int. Cl.

| | |
|---|---|
| ***B61G 3/08*** | (2006.01) |
| ***B61G 3/14*** | (2006.01) |
| ***B61G 3/20*** | (2006.01) |
| ***B61G 3/26*** | (2006.01) |

(52) U.S. Cl. ..... 213/162; 213/159; 213/211

(58) Field of Classification Search ..... 213/159, 213/161–163, 166, 169, 211, 219

See application file for complete search history.

(56) References Cited

U.S. PATENT DOCUMENTS

| | | | | |
|---|---|---|---|---|
| 3,232,444 | A * | 2/1966 | Halon | 213/166 |
| 3,232,445 | A * | 2/1966 | Cisco | 213/166 |
| 3,933,252 | A | 1/1976 | Murphy | |
| 4,010,854 | A * | 3/1977 | Manyek | 213/166 |
| 4,454,953 | A | 6/1984 | Chierici | |
| 4,602,717 | A | 7/1986 | Krzanowsky | |
| 5,129,529 | A * | 7/1992 | Manyek | 213/166 |
| 6,739,464 | B1 | 5/2004 | Manyek | |

* cited by examiner

*Primary Examiner* — S. Joseph Morano
*Assistant Examiner* — Zachary Kuhfuss
(74) *Attorney, Agent, or Firm* — Cook Alex Ltd.

(57) ABSTRACT

A telescoping, uncoupling lever for a railroad car. The lever is formed of round rod and includes a handle rod, a lock lifter rod and a track assembly. The track assembly includes a handle rod track and a lock lifter rod track with tracks connected to each other at their opposite ends. A glide housing is attached to one end of the handle and lock lifter rods to allow the handle and lock lifter rods to slide on the tracks of the track assembly. Each glide housing is tubular, has a cavity extending there through to connect rod openings at the opposite ends and has glide of C-shaped transverse cross-section positioned therein to receive and partially encircle a rod.

10 Claims, 4 Drawing Sheets

TELESCOPING, UNCOUPLING LEVER AND GLIDE HOUSINGS FOR A RAILROAD CAR

BACKGROUND AND SUMMARY OF THE INVENTION

This invention is directed to a telescoping, uncoupling lever and glide housings for railroad cars to replace the conventional three piece uncoupling lever which has been in use in the railroad industry for decades. Uncoupling levers having L-shaped glides and lever members of rectangular cross-section are shown and described in U.S. Pat. No. 4,602,717 and these uncoupling levers are installed on many railroad cars now in service. Uncoupling levers of this type utilize rectangular glide housings for the rectangular lever members. Handle and lock lifter rods are welded to the rectangular lever members to complete the uncoupling lever. The improved tubular glide housing and glides shown and described in U.S. Pat. No. 6,739,464 provide glides which are less likely to be displaced from their glide housings due to damage and wear. However, the uncoupling lever shown and described in this patent still requires the welding of the round handle and lock lifter rods to the rectangular bar stock lever members thereby increasing the manufacturing cost of the uncoupling lever and introduces a possible point of failures at welds.

The novel aspects of this invention provide a telescoping, uncoupling lever in which the handle, lock lifter and other lever elements are each formed of one piece rods of circular transverse cross-section, each of which is bent into its desired shape and does not require welding of the handle or lock lifter rods to other lever elements.

Another feature of this invention is a cast steel tubular glide housing which can be attached to the handle and lock lifter rods for sliding movement on the track rods and also can be attached to the track rods to support and guide the handle and lock lifter rods during sliding movement.

A further feature of this invention is a tubular glide housing which utilizes an interior tubular plastic glide to receive and engage the handle, lock lifter or track rods.

Another feature of this invention is a tubular glide housing having inner locking retaining portions of the glide housing and the glide located inside the glide housing where they are less subject to injury and breakage.

Yet another feature of this invention is a glide that can be installed after a rod is installed in a tubular glide housing Other features of the invention will be found in the following specification, drawings and claims.

BRIEF DESCRIPTION OF THE DRAWINGS

The invention is illustrated more or less diagrammatically in the following drawings wherein.

DESCRIPTION OF THE PREFERRED EMBODIMENT

Figure 1:
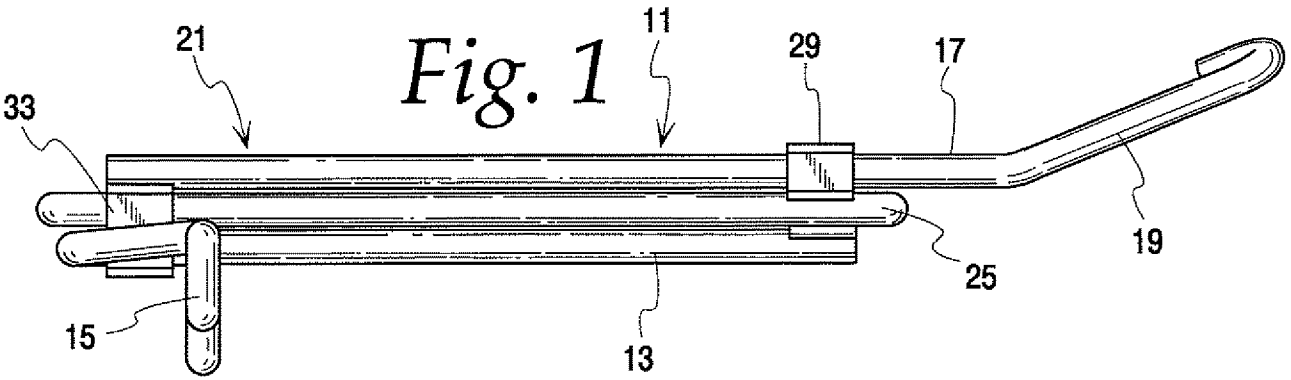
FIG. 1 is a top plan view of a telescoping, uncoupling lever of this invention in its shortened or compressed condition.
Figure 2:
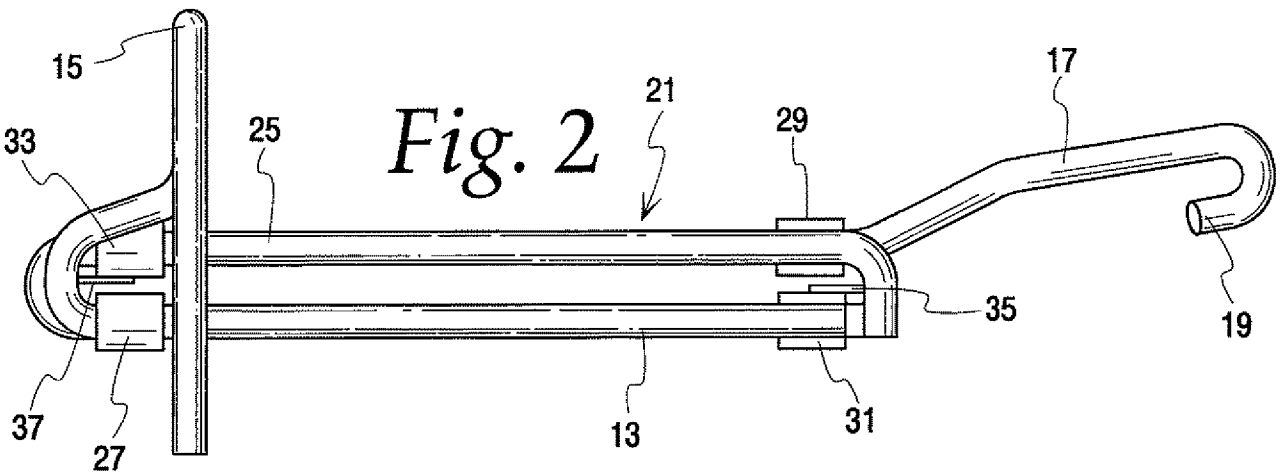
FIG. 2 is a side elevational view of the telescoping, uncoupling lever of FIG. 1.
Figure 3:
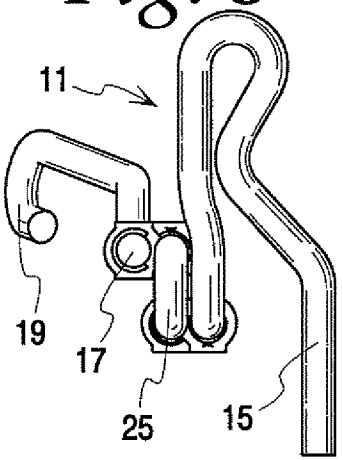
FIG. 3 is a left hand end elevational view of the telescoping, uncoupling lever of FIG. 1.

FIGS. 1-5 of the drawings are views of a telescoping, uncoupling lever 11 of this invention which is intended to be mounted on an end of a railroad freight car. The telescoping, uncoupling lever 11 includes a handle rod 13 having an integral handle 15, a lock lifter rod 17 having an integral lock lifter 19 and a track assembly 21. The track assembly 21 includes a handle rod track 23 and a lock lifter rod track 25. Each of these elements of the telescoping, uncoupling lever, the handle rod lock lifter rod and track assembly are formed from one piece, one inch diameter round bar stock. The use of one inch diameter steel round bar stock for all elements of the uncoupling lever 11 eliminates the need for the more expensive rectangular bar stock used in previous telescoping, uncoupling levers. This new construction also eliminates the need to weld round bar stock handles to rectangular bar stock and does away with the possibility of failure at the welded joints. The handle rod track 23 and the lock lifter rod track 25 are formed from a single piece of bar stock bent back upon itself and welded at its ends. This forms a track structure or assembly in the shape of a closed elongated loop having a rounded end and a straight welded end as can be best seen in FIG. 5 of the drawings.

The handle rod track tubular glide housing 27 is welded on one side to the handle rod track 23. A lock lifter rod track tubular glide housing 29 is welded on one of its sides to the lock lifter track rod 25 at the opposite end of the track assembly from the tubular glide housing 27. A tubular glide housing 31 is welded to the handle rod 13 and telescopes over the handle rod track 23. In like manner, a lock lifter rod guide housing 33 is welded to the end of the lock lifter rod 17 and telescopes over the lock lifter rod track 25. A handle rod compression stop 35 is welded to the tubular glide housing 31 and a similar lock lifter rod compression stop 37 is welded to the lock lifter tubular glide housing 33. The compression stops 35 and 37 engage the rounded and straight ends, respectively, of the track assembly 21 in the compressed position of the telescoping, uncoupling lever. In the fully extended position of the telescoping, uncoupling lever, the engagement of the glide housings 27 and 31 and 29 and 33, respectively, limit the opening movement of the handle rod and lock lifter rod relative to the track assembly. The glide housing assemblies 27, 29, 31 and 33 are identical in construction and are shown in detail in FIGS. 6, 7, 8, 11 and 12 of the drawings. As can best be seen in FIGS. 6 and 7 of the drawings, a glide housing assembly is formed of a cast steel tubular housing 41 having a longitudinal cavity 43 formed therein of irregular transverse cross-section. An opening 45 is located at one end of the cavity and another opening 47 is formed at the opposite end of the cavity. The cavity is defined by an interior wall 49 of irregular transverse cross-section. This interior wall includes an arcuate interior glide encompassing wall 51 which extends for more than 180° of the cavity and another arcuate inwardly facing wall 53 which is located diametrically inwardly a greater distance than the wall 51. The arcuate wall 53 is bounded at its circumferential ends by stop surfaces 55 and 57.

A segmented stop wall 59 is formed adjacent opening 47 into the cavity 43. Gaps 61 are formed in the segmented wall 59 to allow foreign matter to escape from the cavity 43 of the glide housing 41 while preventing the exiting of the glide from the cavity as will be hereinafter discussed.

Figure 8:
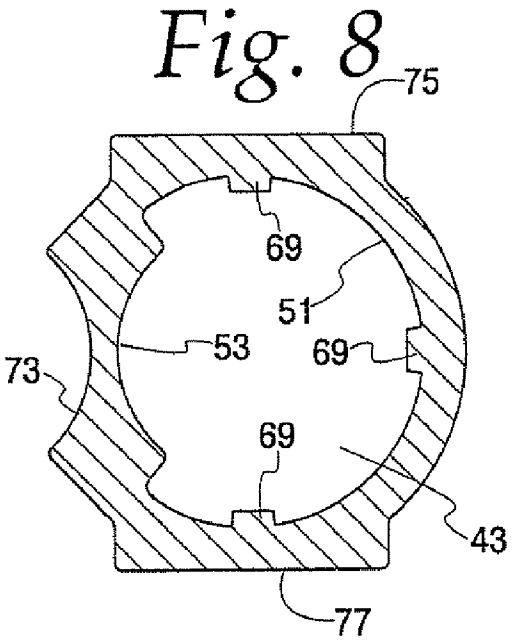
FIG. 8 is a cross-sectional view taken along line 8-8 of FIG. 6.
Figure 6:
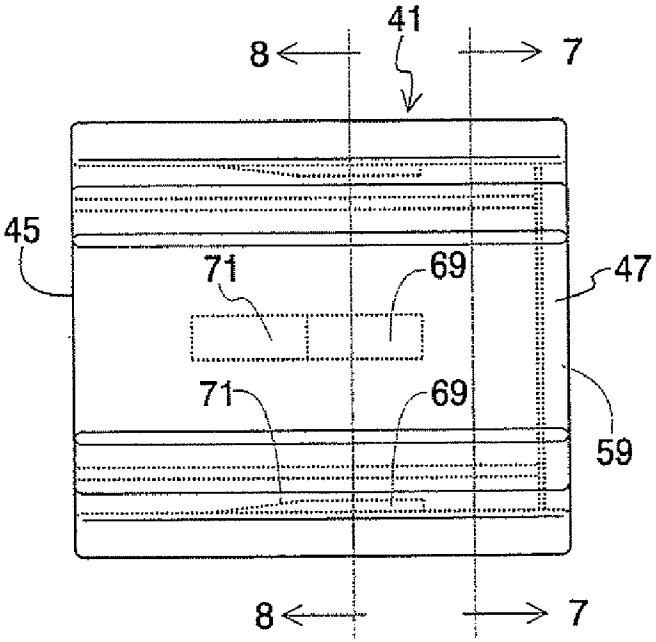
FIG. 6 is an enlarged side elevational view of a elongated, tubular glide housing of the invention.
Figure 7:
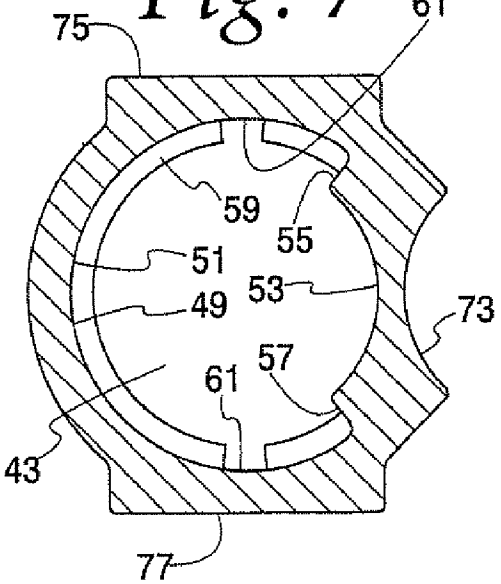
FIG. 7 is a cross-sectional view taken along line 7-7 of FIG. 6.
Figure 9:
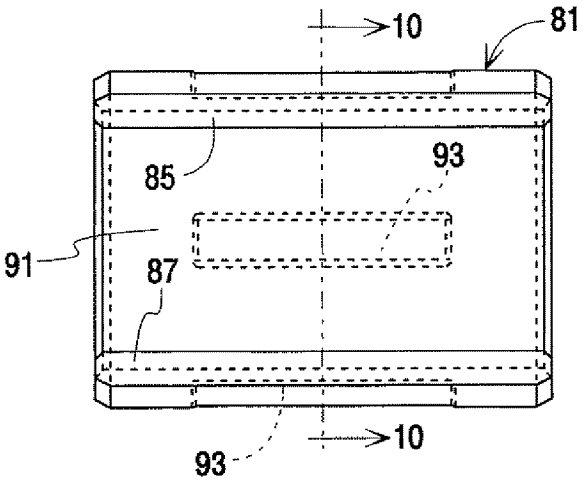
FIG. 9 is an enlarged side elevational view of the glide of this invention.
Figure 12:
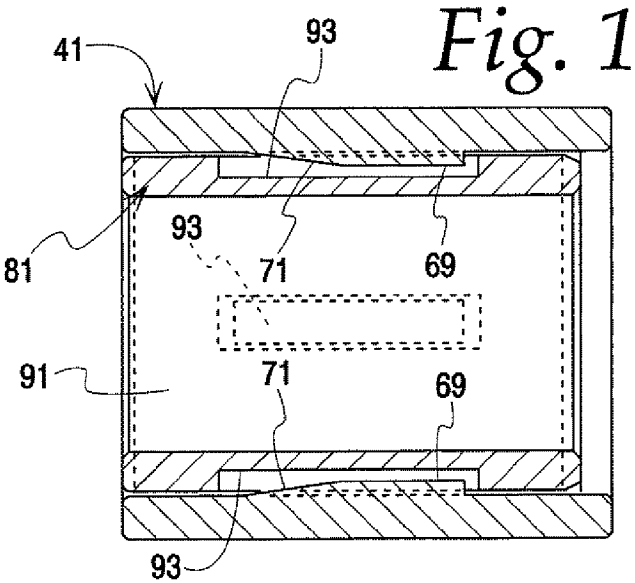
FIG. 12 is a cross-sectional view taken along line 12-12 of FIG. 11 with the rod omitted for clarity of illustration.
Figure 10:
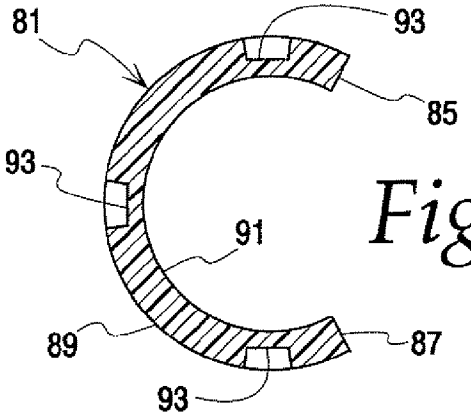
FIG. 10 is a cross-sectional view taken along line 10-10 of FIG. 9.

As can best be seen in the cross-sectional view of FIG. 8 of the drawings, inwardly projecting lugs 69 spaced 90° apart are formed on the interior wall 51 of the cavity 43 of the tubular housing 41. Facing the entrance opening 45 to the cavity as shown in FIG. 6 are tapered ramps 71 which blend into the projections 69.

Figure 4:
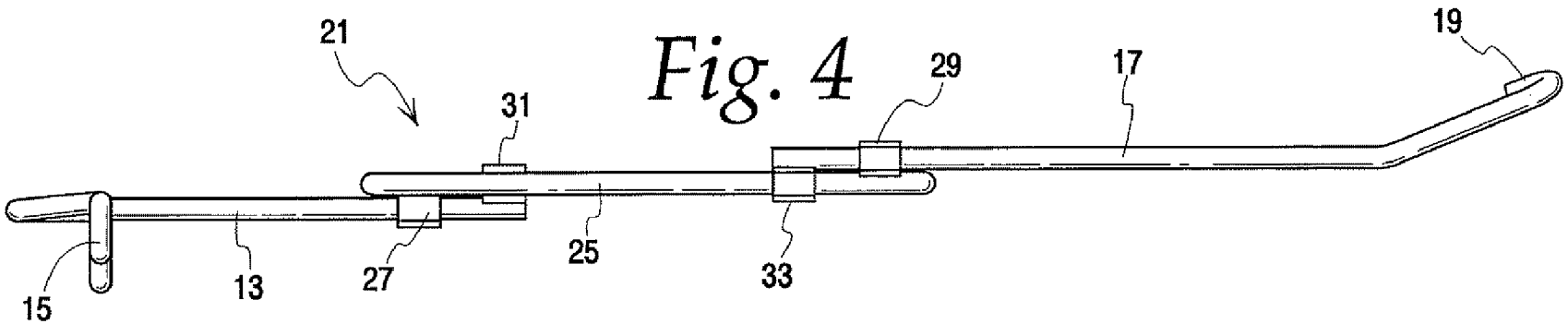
FIG. 4 is a top plan view of the telescoping, uncoupling lever of FIG. 1 in its extended position.
Figure 5:
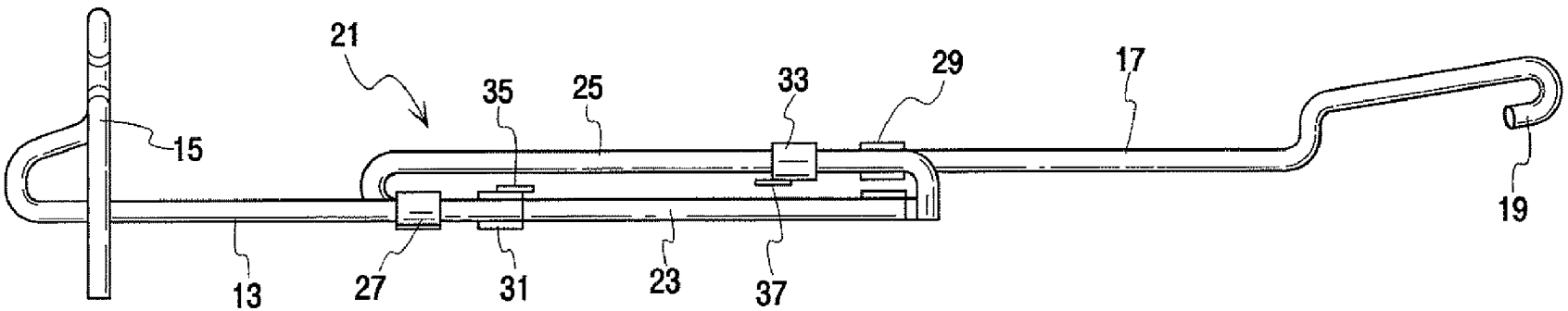
FIG. 5 is a side elevational view of the telescoping, uncoupling lever of FIG. 4.

A concave rod attachment surface 73 is formed on the exterior of a glide housing assembly for attachment to a rod by welding in the manner previously described. Referring in particular to FIGS. 4 and 5 of the drawings, the attachment surface 73 of the glide housing assembly 27 is welded to the track rod 23. The attachment surface 73 of the glide rod assembly 29 is welded to the track rod 25. The attachment surface 73 of the glide rod assembly 31 is welded to the handle rod 13. The attachment surface 73 of the glide rod assembly 33 is welded to the lock lifter rod 17. Welding flats 75 and 77 are formed on opposite diametric walls of the housing 41. Handle rod compression stop 35 is welded to flat 75 and lock lifter rod compression stop 37 is welded to flat 77.

Figure 11:
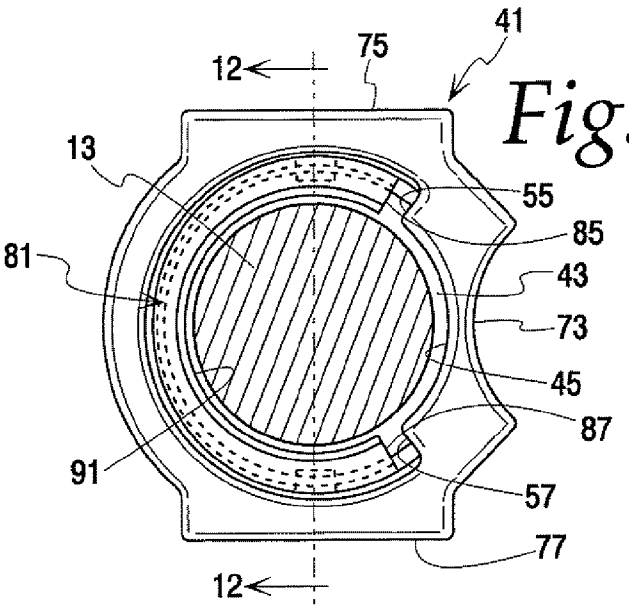
FIG. 11 is an end view of a glide housing having a glide installed therein.

A glide 81 for installation in a glide housing 41 is shown in FIGS. 9 through 12 of the drawings. The glide is formed of a resilient and flexible material such as a high density polyethylene with approximately 2% carbon added to provide ultra violet protection. Other suitable materials may also be used. The carbon is added as a cautionary measure and it may not be necessary in all situations because the glide is almost completely enclosed in the glide housing and exposure to the sun may be minimal. The glide is C-shaped in transverse cross-section with an arcuate extent of more than 180 degrees and is dimensioned to fit in the cavity 43 of a glide housing 41. The glide is formed with longitudinally extending end walls 85 and 87. When positioned in the cavity 43 as shown in FIG. 11, the end walls 85 and 87 are spaced from the stop surfaces 55 and 57 of the arcuate wall 53 and will only contact the stop surfaces upon excessive rotational movement of the slide. The outer longitudinally extending cylindrical surface 89 of the glide 81 has elongated outwardly opening notches 93 formed therein for receiving the projecting lugs 69 of the housing 41 to secure the glide in position in the cavity 43 with only limited rotational and longitudinal movement. One end of the glide 81 engages the segmented stop wall 59 of the housing 41 to prevent it from exiting that end of the cavity 43. When a rod such as a handle rod lock lifter rod or rod track extends through the assembled guide and housing, an example of which is shown in FIG. 11 where the handle rod 13 is depicted, the glide is prevented from sliding out of the glide housing. The inner concave surface 91 of the glide partially surrounds the rod 13 to provide both a sliding and bearing surface for the rod and to maintain the rod clear of the inner concave wall 53 of the glide housing 41. Whereas, a single glide 81 is shown and described, it should be understood and appreciated that two or more shorter glides may be installed in the cavity 43 in place of the single glide shown.

The elements of the telescoping, uncoupling lever 11 and its glide housings are assembled and welded to one another as heretofore described. After assembly and welding, the glides 81 are inserted into their respective glide housings through the openings 45 into the cavities 43 of the glide housings. The glides will be properly positioned in the cavities 43 when the glides contact the segmented stop walls 59 located adjacent the opposite openings 47 into the cavities 43. During the insertion of the glides into the cavities, the inherent flexibility and resiliency of the glides will permit them to engage the tapered ramps 71 of the lugs 69 and slide over these lugs so that the lugs seat in the notches 93 formed in the exterior walls of the glides and thereby retain the slides in position in the cavities. As is most clearly shown in FIG. 11 of the drawings, the glide will receive and partially encircle its rod, in this instance the rod 13, to provide a low friction surface for sliding movement of the rod and to maintain the rod away from the arcuate interior surface 45 of the housing.

The invention claimed is:

1. A telescoping, uncoupling lever for a railroad car, said lever comprising:

an elongated handle rod having a handle at one end thereof, an elongated lock lifter rod having at lock lifter at one end thereof and a track assembly, said track assembly comprising an elongated handle rod track and an elongated lock lifter rod track with said rod tracks connected to each other at their opposite ends and spaced from each other intermediate their opposite ends, each of said rod tracks having a tubular glide housing affixed thereto at one end thereof with said tubular glide housings located at opposite ends of said rod track assembly, said handle rod and said lock lifter rod each mounted for sliding movement in its respective track tubular glide housing, said handle rod having a tubular glide housing affixed thereto near its end opposite to its said handle with said handle rod tubular glide housing receiving its track rod for sliding movement of said handle rod relative thereto, said lock lifter rod having a tubular glide housing affixed thereto near its end opposite to its said lock lifter with said tubular glide housing receiving its track rod for sliding movement of said lock lifter rod relative thereto.

2. The telescoping, uncoupling lever of claim 1 in which each of said elongated handle rod, elongated lock lifter rod, elongated handle rod guide track and elongated lock lifter rod track is substantially circular in transverse cross-section.

3. The telescoping, uncoupling lever of claim 1 in which each of said tubular glide housings includes an elongated cavity extending through said housing to connect openings at opposite ends of said housing, said cavity being dimensioned to receive one of said rods and a glide, said glide installed in said cavity to receive one of said rods, and a stop at one of said rod openings of said cavity to engage said glide to prevent said glide from exiting said cavity through said rod opening having said stop.

4. The telescoping, uncoupling lever of claim 1 in which said glide is arcuate in transverse cross-section and engaging lugs and slots are formed as portions of said glide housing and said glide to limit movement of said glide and said glide housing relative to each other.

5. The telescoping, uncoupling lever of claim 1 in which said track assembly comprises an elongated rod bent back upon itself to form said elongated handle rod track, said elongated lock lifter rod track and said opposite end connections of said tracks.

6. The telescoping, uncoupling lever of claim 1 in which a concave shaped rod attachment surface is formed on the exterior of said tubular glide housing for receiving and attaching to said handle rod, said lock lifter rod and said track rods by welding.

7. A tubular glide housing for rods of a telescoping, uncoupling lever, said tubular glide housing including an elongated cavity extending through said housing to connect rod openings at opposite ends of said tubular housing, said cavity dimensioned to receive one of said rods and at least one glide, and a stop located at one of said rod openings of said cavity to engage said at least one said glide to prevent said at least one said glide from exiting said cavity through said opening having said stop, said at least one said glide has a C-shaped transverse cross-section and engaging lugs and slots are formed as portions of said glide housing and said at least one said glide to limit movement of said glide housing and said at least one said glide relative to each other.

8. The tubular glide housing of claim 7 in which radially extending stop walls are formed in said elongated cavity to engage said at least one said C-shaped glide to limit rotation of said at least one said glide and said glide housing relative to each other.

9. The tubular glide housing of claim 8 in which said lugs are tapered relative to said rod opening having said stop to allow said at least one said glide to be inserted into said cavity at said other rod opening and to resist withdrawal of said at least one said glide from said cavity.

10. The tubular glide housing of claim 7 in which a concave shaped rod attachment surface is formed on the exterior of said tubular glide housing for receiving and attaching to said handle rod, said lock lifter rod and said track rods by welding.

* * * * *